United States Patent [19]

DeRouen et al.

[11] 4,114,132

[45] Sep. 12, 1978

[54] WORM GEAR POTENTIOMETER RATCHET SYSTEM

[75] Inventors: Joseph Rodolph DeRouen, Banning; Lawrence Kucharski, Jr., Sunnymead, both of Calif.

[73] Assignee: Bourns, Inc., Riverside, Calif.

[21] Appl. No.: 800,600

[22] Filed: May 25, 1977

[51] Int. Cl.[2] ..... H01C 10/34

[52] U.S. Cl. ..... 338/174; 74/383; 74/440; 338/184; 338/DIG. 1

[58] Field of Search ..... 338/174, 180, 184, 188, 338/DIG. 1; 74/425, 425.5, 435, 440, 441, 383

[56] References Cited

U.S. PATENT DOCUMENTS

| | | | |
|---|---|---|---|
| 3,099,810 | 7/1963 | Habereder | 338/174 X |
| 3,446,085 | 5/1969 | Ginsberg | 338/DIG. 1 X |
| 3,635,100 | 1/1972 | Littmann | 74/425 X |
| 3,701,070 | 10/1972 | Baldwin et al. | 338/DIG. 1 X |
| 3,768,325 | 10/1973 | Kucharski, Jr. | 74/405 |

*Primary Examiner*—C. L. Albritton
*Attorney, Agent, or Firm*—Paul H. Ware; William G. Becker

[57] ABSTRACT

A lead screw type control for a miniature worm gear actuated potentiometer having a rotor with a main drive spur gear and a ratcheting drive rack gear. The invention contemplates rack gear teeth formed with a gentle ramp opposed to a more acute ramp such as to resemble a sawtooth configuration in profile. The main drive spur gear is formed on less than the total of the rotor circumference. The ratcheting rack gear is mounted on a portion of the rotor circumference that does not include the spur gear. The main drive spur gear teeth are functional in a plane perpendicular to the plane in which the ratcheting rack gears are effective. Ratcheting is accomplished when the driving lead screw has driven the main-drive spur gear to one of its limits in either a clockwise or counterclockwise direction. At this point, if the same direction of rotation is continued, the ratcheting rack gear is urged into engagement with the driving lead screw by the force of a contact spring. As long as the same direction rotation of the driving lead screw is maintained, the engagement continues so as to permit continued ratcheting and thus rotation of the worm gear without causing damage to the movable parts of the worm gear actuated potentiometer.

11 Claims, 5 Drawing Figures

WORM GEAR POTENTIOMETER RATCHET SYSTEM

BACKGROUND OF THE INVENTION

1. Field of the Invention

This invention relates generally to the field of variable resistance devices and more particularly to ratcheting mechanisms for worm gear actuated potentiometers.

2. Description of the Prior Art

Worm gear actuated potentiometers are well-known in the art and have been for some time. A common problem encountered in the construction of devices of this kind is in the method of provision of means by which excessive rotation of the driving element can be accommodated without damage to internal elements. In most applications it is necessary to provide a stop so as to prevent the contact from being rotated through an indefinite number of rotations. Lacking such a stop provision, the resistance ratio may suffer discontinuous changes as a result of the travel of the wiper into and through open circuit conditions. In many prior art worm gear actuated potentiometers, positive stops were provided which prevented the wiper from rotating through such a distance as to lose contact with the resistance element. These stops solved the problem of discontinuous change of the resistance ratio by limiting the wiper travel, however, another problem was thus generated. In the early prior art worm gear actuated potentiometers, continued rotation of the drive screw after a limit stop was reached would cause stripping of the gears on the driven rotor carrying the wiper, thus causing destruction of the device. This was a very frequent occurence since the interior of the worm gear actuated potentiometer was not usually visible to the operator. In some of the later devices, friction clutch means were employed such that when the wiper reached a limit stop, the friction means would allow slippage so as not to damage the interior elements as a result of excessive rotation of the driving screw. Some of these devices, however, also allow slippage under conditions that the wiper has not reached a limit stop and thus operation becomes erratic and unreliable. Various ratcheting devices have subsequently been employed in attempts to solve the problem presented. Most have either presented new problems or only partially solved the problem presented. Most of these devices have thus met special needs as presented by specific problems and have therefore served narrow purposes. These prior art devices, among other disadvantages, have required separate stop mechanisms in addition to the ratcheting mechanism, have been unreliable and unpredictable in operation under continued use and have been expensive and complicated to manufacture. Some of these prior art devices have been described in the following listed patents that were brought to the attention of the applicant through a novelty search conducted in the United States Patent and Trademark Office:

1. No. 3,497,856 — "Adjustable Potentiometer" — L. W. Scheel
2. No. 3,242,452 — "Clutch Means for Multiple Turn Variable Resistor" — A. A. Grunwald, et al.
3. No. 3,768,325 — "Multiturn Adjustment Potentiometer Ratcheting Mechanism" — L. Kucharski, Jr.
4. No. 3,683,308 — "Potentiometers" — A. L. Hamill 5. No. 3,569,896 — "Ultrathin Miniature Potentiometer with Recessed Drive Means" — W. D. Kirkendall
6. No. 3,522,573 — "Potentiometer Shaft Retention" — R. D. Michik
7. No. 3,522,572 — "Gear Adjusted Potentiometer" — R. D. Michik
8. No. 3,208,024 — "Potentiometer Construction" — H. B. Enos et al.
9. No. 3,099,810 — "Miniature Potentiometer" — H. Habereder
10. No. 3,416,119 — "Variable Resistance Control with Clutch Mechanism" — J. Van Beuthuysen
11. No. 3,115,614 — "Miniature Potentiometer with Stop Mechanism" — H. Habereder
12. No. 3,701,070 — "Worm Gear Actuated Potentiometer" — K. B. Baldwin et al.
13. No. 3,582,857 — "Worm Driven Adjustable Potentiometer" — J. F. Kishel
14. No. 3,639,878 — "Adjustable Potentiometer with Contactor Ratchet and Central Post Securing Means for Baseplate" — L. W. Scheel
15. No. 3,478,294 — "Variable Resistor" — W. D. Kirkendall
16. No. 3,446,085 — "Variable Resistor" — L. Ginsberg
17. No. 3,384,851 — "Gear Adjusted Potentiometer" — W. H. King
18. No. 3,378,803 — "Variable Resistance Potentiometer" — C. Yungblut et al.

It would thus be a great advantage to the art to provide an improved ratcheting mechanism for a worm gear actuated potentiometer;

It would be another great advantage to the art to provide an improved ratcheting mechanism for a worm gear actuated potentiometer which is simple and inexpensive to manufacture;

A further desirable advantage to the art would be to provide a ratcheting mechanism for a worm gear actuated potentiometer which is predictable and reliable;

A still further desirable advantage to the art would be the provision of a worm gear actuated potentiometer having a ratchet member and a drive member that are urged into engagement through the action of a commonly presently employed element;

It would also be great advantage to the art to provide a worm gear actuated potentiometer showing the advantages of ratcheting to prevent interior damage to the elements that will have a long operating life.

SUMMARY OF THE INVENTION

It is an object of the present invention to provide an improved ratcheting mechanism for a worm gear actuated potentionmeter;

A further object of the present invention is to provide an improved ratcheting mechanism for worm gear actuated potentiometers which is simple and inexpensive to manufacture;

A still further object of the present invention is to provide a ratcheting mechanism for a worm gear actuated potentiometer which is predictable and reliable;

An additional object of the present invention is to provide a construction and arrangement which comprises a minimum number of parts and which parts are themselves simple and efficient in operation over prolonged periods of use.

In the accomplishment of these and other objects a worm gear actuated potentiometer is provided in which the rotary element of the invention includes a disk having on one face the contact spring and on its opposite face a rotary spur gear. The spur gear teeth extend through an angular distance of less than 360°. At each end of the spur gear teeth, rack gear teeth project downward perpendicularly from the disk. At the end of the rotary gear travel the spur gear teeth become disengaged from the screw shaft. The rack gear teeth are urged into engagement with the screw shaft by the spring force of the contact spring located on the opposite side of the disk. The rack gear teeth are formed with a gentle ramp on one side to facilitate ratcheting and a steep angle on the other side for driving the rotor when the direction of the screw shaft rotation is reversed and reengagement with the spur gear is accomplished.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which.

DETAILED DESCRIPTION

Although specific embodiment of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pretains are deemed to be within the spirit, scope, and contemplation of the invention as further defined in the appended claims.

Figure 1:
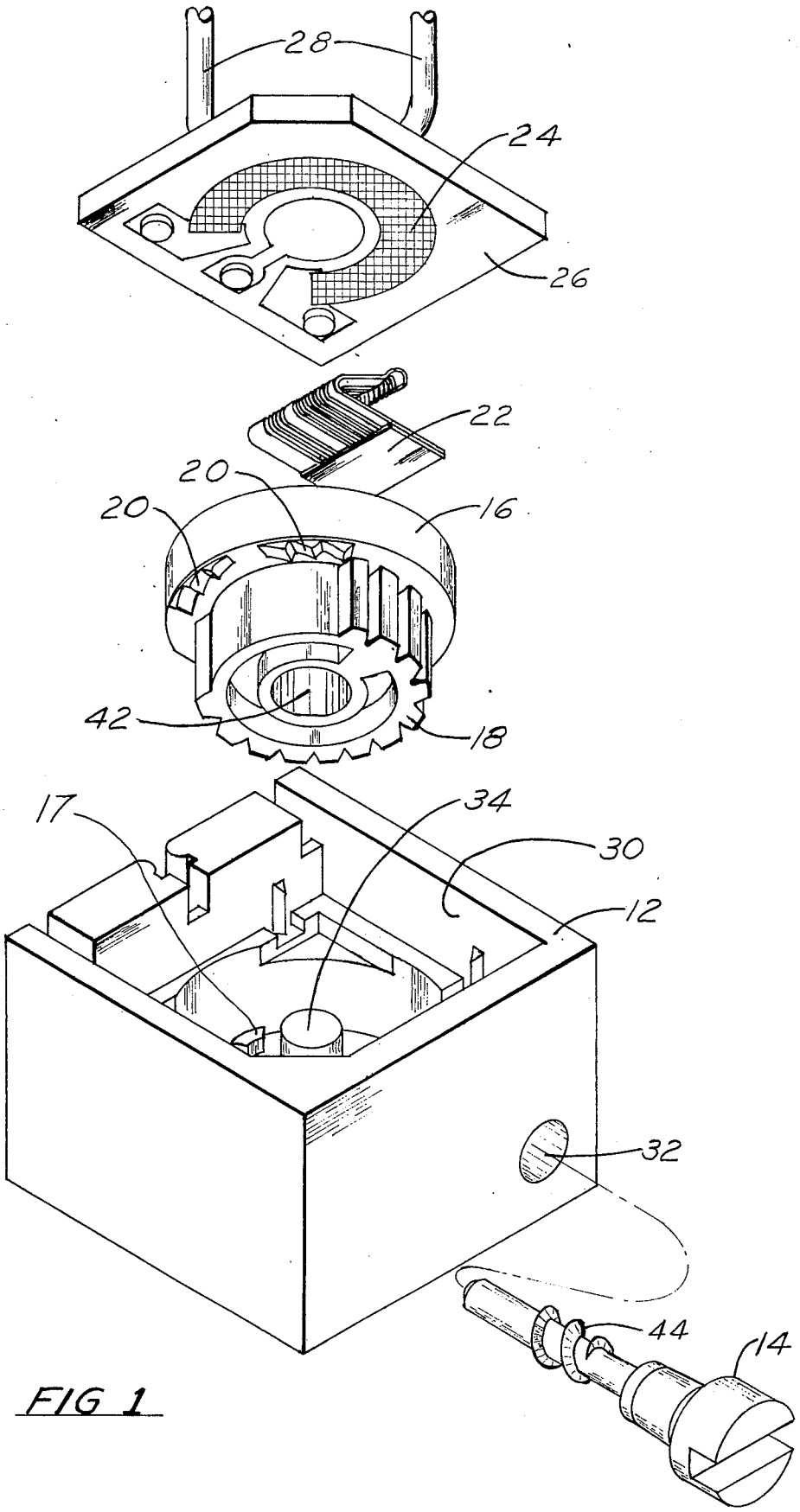
FIG. 1 is an exploded view of a worm gear actuated potentiometer incorporating the present invention.

Referring to FIG. 1 with greater particularity, there is illustrated an exploded view of a worm gear actuated potentiometer incorporating the advantages of the invention. The worm gear actuated potentiometer, denoted generally by the numeral 10, comprises essentially a housing 12 which has a cavity 30 in which is mounted a positioning center post 34 and the necessary holes, slots, and promontories to accept the elements of the worm gear actuated potentiometer. A worm screw, denoted by the numeral 14, has on its shaft a worm gear 44. A port 32 is provided in the housing 12 for insertion of the worm gear 14. Means to secure the worm gear within cavity 30 after fabrication are well-known in the art. The gear carrying rotor 16 includes spur gear 18 which is the main drive gear, mating aperture 42 to fit over positioning center post 34, and rack gears 20. A wiper contact spring 22 serves the dual purpose of maintaining contact with the potentiometer element 24 and urging the rack gears 20 into engagement with worm gear 44 whenever rotor 16 has reached a limit of its travel against stop 17 in either direction. The nonconductive substrate upon which the resistive element 24 is formed has been denoted by the numeral 26 and termination leads are denoted by numeral 28.

Figure 2:
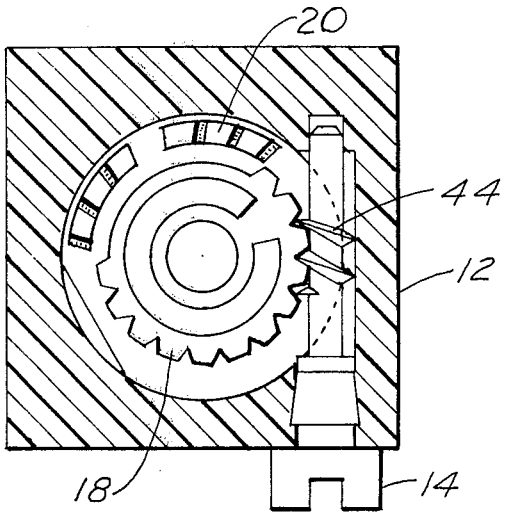
FIG. 2 is a plan view showing engagement of the worm screw and the rotor spur gear teeth.

Referring now to FIG. 2, there is shown a plan view with worm screw 14 having been inserted into the housing 12 and engaging spur gears 18. The teeth of the rack gear 20 are shown as perpendicular to the teeth of spur gear 18.

Figure 3:
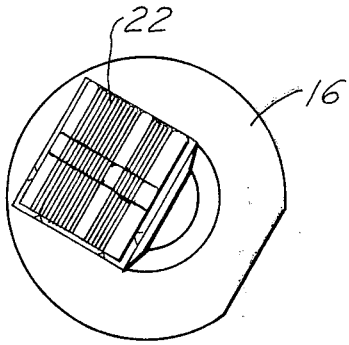
FIG. 3 is a plan view showing the wiper attached to the disk.

FIG. 3 shows the wiper contact spring 22 mounted on the rotor 16.

Figure 4:
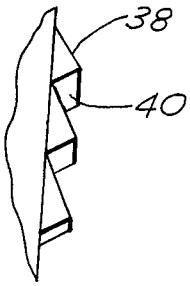
FIG. 4 is a fragmentary perspective drawing showing detail of the construction of the rack gear teeth.

Referring now to FIG. 4, the detail of the rack gears may be best explained. The rack teeth have been specially designed to allow easy ratcheting but still provide positive engagement for return to the spur gear when the shaft is reversed. One side of each tooth in the rack gear is a gentle angle for ratcheting. The opposite side for driving is a much steeper angle. The numeral 38 denotes the gentle angle while numeral 40 shows the very steep angle. Reference to FIG. 1 shows that there are two sets of rack teeth; one for clockwise ratcheting and one for counterclockwise ratcheting.

Figure 5:
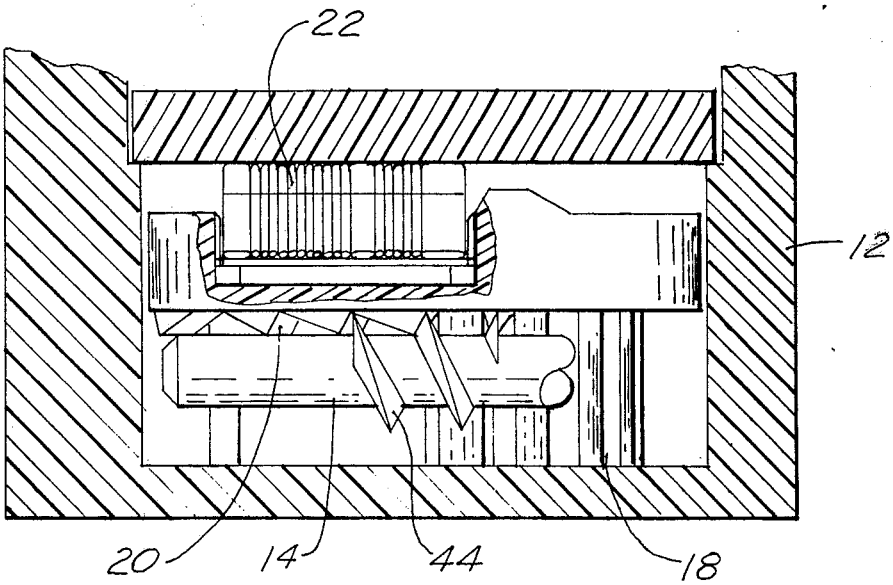
FIG. 5 is a side elevational drawing showing the worm screw in engagement with the rack teeth.

FIG. 5 is a side elevation in which the wiper contact spring 22 is shown as urging the engagement of rack gear teeth 20 with worm gear teeth 44 of worm screw 14. Reversal of the direction of rotation of the worm screw 14 will reengage the worm gear 44 with spur gear teeth 18.

Thus the rotor 16 incorporates two sets of gear teeth that enable it to switch from a positive drive plane to a ratcheting plane at each end of the wiper travel. A more positive clutching type function is performed by the rack gear teeth placed perpendicular to standard positive drive teeth of the spur gear 18. The specially shaped clockwise and counterclockwise rack gear teeth 20 molded onto the rotor 16 permit easy ratcheting yet positive reengagement to the main drive spur gear 18.

The wiper contact 22 serves a dual purpose. One, as a conventional potentiometer collector contact, and the other as a ratcheting member spring. After the rotor gear has engaged a mechanical stop, the wiper contact spring maintains engagement between the worm gear teeth 44 and rack teeth 20. The elimination of the ratchet clip used in many prior art devices improves the reliability of the overall device. The wiper contact spring as used in the present invention obviates the need for a ratcheting clip.

Thus, there has been described a worm gear potentiometer ratchet system that will provide positive ratcheting yet also provide positive reengagement with the main drive gear. Great improvements in reliability, flexibility, maintainability, ease of operation have been provided through the novel advantages of the invention.

It is pointed out that although the present invention has been shown and described with reference to particular embodiment, nevertheless various changes and modifications obvious to one skilled in the art to which the invention pertains are deemed to lie within the purview of the invention.

What is claimed and desired to be secured by Letters Patent of the United States is:

1. A worm gear actuated potentiometer mounted in a housing comprising:

a rotatable worm screw having threads and mounted so as to be adjustable without limit in clockwise and counterclockwise directions from outside the housing of the variable potentiometer;

a rotor having spur gear teeth on less than 360° of its circumference in drivable engagement with said worm screw;

rack gear teeth mounted to a portion of the circumference of said rotor not occupied by said spur gear teeth;

stop means to limit the rotation of said rotor to less than 360°; and wiper contact spring means for urging the rack gear teeth into engagement with the worm screw and for maintaining collector wiper contact with the resistance element of the worm gear actuated potentiometer.

2. The system of claim 1, wherein the spur gear teeth and the rack gear teeth are molded onto the rotor.

3. The device of claim 2, wherein the spur gear teeth and rack gear teeth are molded on planes perpendicular to each other.

4. The system of claim 1, wherein the rack gear teeth are wedge-shaped.

5. The device of claim 4, wherein one ramp of the wedge is more acute than the other.

6. A ratcheting mechanism for a worm gear actuated potentiometer comprising:

a rotatable worm screw having threads and mounted so as to be adjustable without limit in clockwise and counterclockwise directions from outside the housing of the variable resistance device;

a rotor having spur gear teeth on less than 360° of its circumference in drivable engagement with said worm screw;

stop means to limit the rotation of said rotor to less than 360°;

rack gear teeth mounted to a portion of the circumference of said rotor not occupied by said spur gear teeth; and wiper contact spring means for urging the rack gear teeth into engagement with the worm screw and for maintaining collector wiper contact with the resistance element of the worm gear actuated potentiometer.

7. The device of claim 6, wherein the spur gear teeth and the rack gear teeth are molded onto the rotor in planes perpendicular to each other.

8. The device of claim 6, wherein the rack gear teeth are wedge-shaped.

9. The device of claim 8, wherein one ramp of the wedge is more acute than the other.

10. A method of ratcheting when the rotor of a worm gear actuated potentiometer reaches a limit stop comprising the steps of:

rotating an adjusting lead screw having threads in the same direction in which the limit stop was contacted;

disengaging the threads of the adjusting lead screw from a main drive spur gear;

engaging the threads of the adjusting lead screw with a ratcheting rack gear.

11. The method of claim 10, wherein reengagement of the threads of the adjusting lead screw with the main drive spur gear is provided by reversal of the direction of adjustment of the lead screw.

* * * * *